US008118011B2

(12) United States Patent
Hirose

(10) Patent No.: US 8,118,011 B2
(45) Date of Patent: Feb. 21, 2012

(54) MARINE VESSEL PROPULSION DEVICE

(75) Inventor: Eiichi Hirose, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 348 days.

(21) Appl. No.: 12/512,210

(22) Filed: Jul. 30, 2009

(65) Prior Publication Data

US 2010/0031931 A1 Feb. 11, 2010

(30) Foreign Application Priority Data

Aug. 8, 2008 (JP) ..... 2008-205027

(51) Int. Cl.
*F02M 37/20* (2006.01)
*F02M 37/00* (2006.01)

(52) U.S. Cl. ..... 123/516; 123/520

(58) Field of Classification Search ..... 123/516, 123/518, 520, 198 D
See application file for complete search history.

(56) References Cited

U.S. PATENT DOCUMENTS 5,137,002 A * 8/1992 Mahoney et al. ..... 123/516
5,220,896 A * 6/1993 Blumenstock et al. ..... 123/520
5,315,980 A * 5/1994 Otsuka et al. ..... 123/520
2005/0016504 A1 1/2005 Saito et al.

* cited by examiner

*Primary Examiner* — Mahmoud Gimie
(74) *Attorney, Agent, or Firm* — Keating & Bennett, LLP

(57) ABSTRACT

A marine vessel propulsion device includes an engine, a fuel injection device, an intake system, a vapor separator tank arranged to separate fuel vapor from liquid fuel to be supplied to the engine, a pump unit arranged to transport the fuel from the vapor separator tank to the fuel injection device, a fuel pipe arranged to connect the fuel injection device and the pump unit, a vapor pathway arranged to connect the vapor separator tank and the intake system, a valve disposed in the vapor pathway, and an engine control unit. The engine control unit is arranged to control the opening degree of the valve in accordance with a valve opening speed set based on at least the pressure of the fuel in the fuel pipe when starting the engine.

11 Claims, 14 Drawing Sheets

MARINE VESSEL PROPULSION DEVICE

BACKGROUND OF THE INVENTION

1. Field of the Invention

The present invention relates to a marine vessel propulsion device including a vapor pathway connecting a vapor separator tank to an intake system, and a valve disposed in the vapor pathway.

2. Description of Related Art

An outboard motor is an example of a marine vessel propulsion device. An outboard motor of one prior art is disclosed in U.S. Patent Application Publication No. US2005/0016504 A1. The outboard motor includes a vapor pathway connecting a vapor separator tank and an intake system, a valve interposed in the vapor pathway, and an engine controller which controls the valve. Fuel is supplied from a fuel tank to the vapor separator tank by a low pressure fuel pump. The fuel in the vapor separator tank is supplied to a fuel injection device (fuel injector) by a high pressure fuel pump.

The engine controller closes the valve while the engine is stopped, and controls the valve to gradually open the valve when starting the engine. Therefore, during operation of the engine, the valve is kept open. When the engine operates, the temperature of the fuel in the vapor separator tank is raised by radiation heat from the engine, and generates fuel vapor. The vapor is allowed to escape to the intake system through the vapor pathway, so that the vapor can be burned. When the engine is stopped, the engine controller closes the valve. Accordingly, when the engine is stopped, the vapor can be prevented from being allowed to escape to the outside.

SUMMARY OF THE INVENTION

The inventors of the present invention described and claimed in the present application conducted an extensive study and research regarding a marine vessel propulsion device, such as the one described above, and in doing so, discovered and first recognized new unique challenges and problems as described in greater detail below.

More specifically, as a result of studying marine vessel propulsion devices including the one described above, the inventors of the present invention described and claimed in the present application discovered that, in such a marine vessel propulsion device, immediately after the engine is stopped, the temperature of the engine is high, so that vapor is generated inside the vapor separator tank due to radiation heat from the engine. Therefore, the inner pressure of the vapor separator tank increases. When the engine is started in this state, if the valve is opened too fast, the vapor inside the vapor separator tank is taken all at once into the engine via the vapor pathway and the intake system. As a result, air/fuel mixture to be supplied to the engine becomes fuel-rich, so that the engine may stall.

When the valve is opened too fast, the pressure inside the vapor separator tank suddenly lowers, so that the fuel in the vapor separator tank bubbles due to vacuum boiling. In this case, the high pressure fuel pump which transports the fuel to the fuel injection device suctions bubbles of the fuel and does not normally operate. This also causes the engine to stall.

On the other hand, when the valve is opened too slowly, the pressure inside the vapor separator tank does not lower, so that it becomes difficult for the low pressure fuel pump to transport new fuel to the vapor separator tank. If this state is continued for an extended period of time, during the operation of the engine, the fuel in the vapor separator tank runs short, and the engine stalls.

In order to overcome the previously unrecognized and unsolved problems described above, a preferred embodiment of the present invention provides a marine vessel propulsion device including an engine, a fuel injection device arranged to inject fuel to the engine, an intake system which includes an air passage of air to be supplied to the engine, a vapor separator tank arranged to separate fuel vapor from liquid fuel to be supplied to the engine, a pump unit arranged to transport the fuel from the vapor separator tank to the fuel injection device, a fuel pipe arranged to connect the fuel injection device and the pump section, a vapor pathway arranged to connect the vapor separator tank and the intake system, a valve disposed in the vapor pathway, and an engine control unit arranged to control an opening degree of the valve. The engine control unit maybe arranged to control the opening degree of the valve based on a valve opening speed set based on at least the pressure of fuel inside the fuel pipe when starting the engine.

"When starting engine" is a wide-ranging concept including not only the time to start the engine and the time immediately after starting the engine, but also a period until a normal operation state is reached after the start of the engine.

By controlling the opening degree of the valve based on the valve opening speed set based on at least the pressure of the fuel inside the fuel pipe, the valve can be opened so as not to lower the pressure of the fuel inside the fuel pipe. Accordingly, the engine can be prevented from stalling due to lowering of the pressure of the fuel inside the fuel pipe.

When the pump unit suctions the fuel bubbled by vacuum boiling inside the vapor separator tank (that is, bubble clogging) and does not normally operate, the pressure of the fuel inside the fuel pipe lowers. Therefore, based on the pressure of the fuel inside the fuel pipe, the valve opening speed is set. Accordingly, the inner pressure lowering in the vapor separator tank can be prevented, so that vacuum boiling can be prevented. As a result, the engine can be prevented from stalling due to bubble clogging.

If the fuel in the vapor separator tank runs short (hereinafter, referred to as "fuel shortage"), the pressure of the fuel inside the fuel pipe also lowers. Therefore, by setting the opening degree of the valve based on the pressure of the fuel inside the fuel pipe, the engine can be prevented from stalling due to fuel shortage.

In a preferred embodiment of the present invention, the valve opening speed is set based on, in addition to the pressure of the fuel inside the fuel pipe, the air/fuel ratio of the air/fuel mixture to be supplied to the engine. With this arrangement, the opening degree of the valve is properly controlled based on the air/fuel ratio in addition to the pressure of the fuel inside the fuel pipe. Accordingly, the air/fuel mixture to be supplied to the engine can be prevented from becoming excessively fuel-rich. Accordingly, the engine can also be prevented from stalling due to an excessively fuel-rich state.

In a preferred embodiment of the present invention, the valve opening speed is set based on, in addition to the pressure of the fuel inside the fuel pipe, a remaining amount of the fuel in the vapor separator tank. With this arrangement, the valve opening degree is controlled based on, in addition to the pressure of the fuel inside the fuel pipe, the remaining fuel amount. In the case where the pressure of the fuel inside the fuel pipe is low, when the remaining amount of the fuel in the vapor separator tank is large, it can be determined that lowering of the pressure of the fuel inside the pipe is caused by bubble clogging. In the case where the pressure of the fuel inside the pipe is low, when the remaining amount of the fuel in the vapor separator tank is small, it can be determined that lowering of the pressure of the fuel inside the fuel pipe is caused by fuel shortage. By thus identifying the cause of lowering of the pressure of the fuel inside the fuel pipe, the valve opening speed can be more properly set. Accordingly, the engine can be further prevented from stalling.

In a preferred embodiment of the present invention, the engine control unit has a storage section which stores a preset valve opening speed. When starting the engine, the engine control unit controls the opening degree of the valve based on the set value stored in the storage section. For example, a set value of the valve opening speed which at least does not cause lowering of the pressure of the fuel inside the pipe is determined in advance through an experiment and stored in the storage section. Accordingly, when starting the engine, the opening degree of the valve is controlled based on the set value, so that without providing sensors, the opening degree of the valve can be easily controlled so as not to cause the engine to stall.

In this case, preferably, when starting the engine, the engine control unit may open the valve at a fixed speed based on the valve opening speed (set value) stored in the storage section. With this arrangement, the opening degree of the valve can be more easily controlled.

Another preferred embodiment of the present invention provides a marine vessel propulsion device that includes an engine, a fuel injection device arranged to inject fuel to the engine, an intake system including an air passage of air to be supplied to the engine, a vapor separator tank arranged to separate fuel vapor to be supplied to the engine from liquid fuel, a pump unit arranged to transport fuel from the vapor separator tank to the fuel injection device, a fuel pipe arranged to connect the fuel injection device and the pump unit, a fuel pressure sensor arranged to detect the pressure of fuel inside the fuel pipe, a vapor pathway arranged to connect the vapor separator tank and the intake system, a valve disposed in the vapor pathway, and an engine control unit arranged to control the opening degree of the valve. In this case, when starting the engine, the engine control unit may preferably control the opening degree of the valve based on at least a detected value of the fuel pressure sensor. With this arrangement, the opening degree of the valve can be controlled in real time so as not to cause lowering of the pressure of fuel inside the fuel pipe.

For example, an engine control unit may be arranged to correct a prescribed value of the valve opening degree to be applied during normal operation based on at least a detected value of the fuel pressure sensor.

A marine vessel propulsion device of a preferred embodiment further includes, in addition to the fuel pressure sensor, an air/fuel ratio sensor arranged to detect an air/fuel ratio of an air/fuel mixture to be supplied to the engine. In this case, when starting the engine, preferably, the engine control unit may control the opening degree of the valve based on, in addition to the detected value of the fuel pressure sensor, a detected value of the air/fuel ratio sensor. With this arrangement, the opening degree of the valve can be controlled in real time so as not to cause the air/fuel mixture to become excessively fuel-rich due to escape of vapor in the vapor separator tank to the air intake system.

A marine vessel propulsion device according to a preferred embodiment of the present invention further includes, in addition to the fuel pressure sensor, a remaining amount sensor arranged to detect a remaining amount of fuel in the vapor separator tank. In this case, when starting the engine, preferably, the engine control unit may control the opening degree of the valve also based on a detected value of the remaining amount sensor in addition to the detected value of the fuel pressure sensor. With this arrangement, the valve opening degree is controlled based on the fuel remaining amount in addition to the pressure of the fuel inside the fuel pipe. In the case where the pressure of fuel inside the fuel pipe is low, when the remaining amount of fuel in the vapor separator tank is large, it can be determined that lowering of the pressure of fuel inside the fuel pipe is caused by bubble clogging. In the case where the pressure of fuel inside the pipe is low, when the remaining amount of the fuel in the vapor separator tank is small, it can be determined that lowering of the pressure of the fuel inside the fuel pipe is caused by fuel shortage. By thus identifying the cause of lowering of the pressure of the fuel inside the fuel pipe, the valve opening degree can be more properly set. Accordingly, the engine can be more effectively prevented from stalling.

A marine vessel propulsion device according to a preferred embodiment of the present invention further includes, in addition to the fuel pressure sensor, a fuel temperature sensor arranged to detect the temperature of the fuel in the vapor separator tank. When starting the engine, preferably, the engine control unit may set the opening degree of the valve to a prescribed value in the case where the temperature of the fuel detected by the fuel temperature sensor is lower than a predetermined temperature, and in the case where the temperature of the fuel detected by the fuel temperature sensor is not lower than the predetermined temperature, the engine control unit may control the opening degree of the valve based on at least the detected value of the fuel pressure sensor. When the temperature of the fuel in the vapor separator tank is high, a lot of vapor is generated. Therefore, when the temperature of the fuel in the vapor separator tank is high, by controlling the opening degree of the valve according to the pressure of the fuel inside the fuel pipe, engine stall caused by the vapor can be prevented.

In the arrangement including the fuel pressure sensor, preferably, when starting the engine, the engine control unit may acquire a detected value of the fuel pressure sensor every predetermined time period, and control the opening degree of the valve based on at least the detected value of the fuel pressure sensor. With this arrangement, the opening degree of the valve can be set in real time suitably for the state of the marine vessel propulsion device.

In this case, preferably, when starting the engine, the engine control unit may change the opening speed of the valve by increasing, reducing, or keeping the opening degree of the valve every predetermined time period. With this arrangement, the opening speed of the valve can be properly controlled in real time so as not to cause the engine to stall.

Other elements, features, steps, characteristics, and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
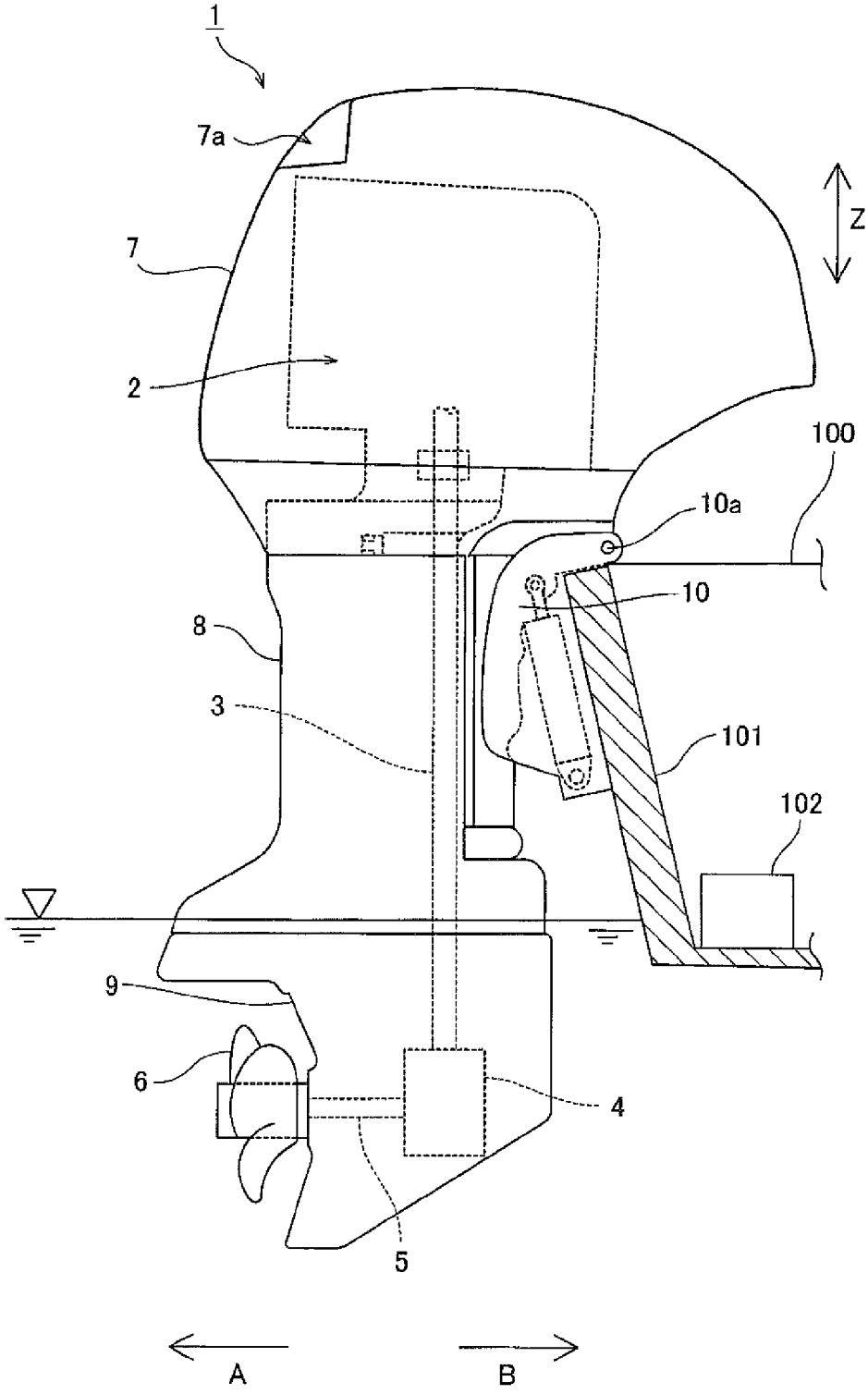
FIG. 1 is a side view showing an entire arrangement of an outboard motor according to a first preferred embodiment of the present invention.

FIG. 1 is a side view showing an entire arrangement of an outboard motor of a first preferred embodiment of the present invention. The outboard motor 1 of the present preferred embodiment is mounted on a transom 101 of a hull 100 via a clamp bracket 10 so as to be steered and tilted. Therefore, the outboard motor 1 assumes various postures with respect to the hull 100 in actual use; however, in the present specification, for the sake of convenience, up-down, left-right, and front-rear directions are determined based on a predetermined reference posture of the outboard motor 1. The reference posture is a posture of the outboard motor 1 at a steering angle of zero and a tilt angle of zero with respect to the hull 100 in a horizontal posture. In this state, when a forward propulsive force is generated from the outboard motor 1, the hull 100 moves straight ahead. In other words, in the present specification, as expressions showing the directions of the outboard motor 1 and the members, the heading direction of the hull 100 when it moves ahead, in other words, when it moves straight ahead will be referred to as "front," and the direction 180 degrees opposite to the front will be referred to as "rear." The left side of the heading direction when the hull 100 moves ahead will be referred to as "left," and the right side of the heading direction when the hull 100 moves ahead will be referred to as "right."

The outboard motor 1 includes an engine section 2, a drive shaft 3, a forward-reverse switching mechanism 4, a propeller shaft 5, and a propeller 6. The drive shaft 3 is arranged to extend in the vertical direction (Z direction), and is rotated by a driving force of the engine section 2. The forward-reverse switching mechanism 4 is coupled to the lower end of the drive shaft 3. The propeller shaft 5 extends in the horizontal direction, and is coupled to the forward-reverse switching mechanism 4. The propeller 6 is attached to the rear end of the propeller shaft 5.

The engine section 2 is housed inside an engine cover 7. Inside an upper case 8 and a lower case 9 which are arranged below the engine cover 7, the drive shaft 3, the forward-reverse switching mechanism 4, and the propeller shaft 5 are housed.

The outboard motor 1 is attached to the transom 101 provided on the reverse (arrow A direction) side of the hull 100 via a clamp bracket 10. The clamp bracket 10 supports the outboard motor 1 such that the outboard motor 1 can swing up and down around the tilt shaft 10*a* with respect to the hull 100. In the hull 100, a fuel tank 102 for storing fuel (gasoline) is provided. The fuel tank 102 and the engine section 2 of the outboard motor 1 are connected by a fuel pipe, not shown. The engine section 2 of the outboard motor 1 is driven by using fuel supplied from the fuel tank 102.

The drive shaft 3 is rotated by a driving force of the engine section 2. The rotation of the drive shaft 3 is transmitted to the propeller shaft 5 via the forward-reverse switching mechanism 4. Accordingly, the propeller 6 is rotated. The forward-reverse switching mechanism 4 can switch the rotation direction of the propeller shaft 5. Accordingly, the rotation direction of the propeller 6 is switched. As a result, the hull 100 is propelled in the forward drive direction (arrow B direction) or in the reverse drive direction (arrow A direction) On the side portion on the reverse drive direction side (arrow A direction) of the engine cover 7, a vent hole 7*a* is provided. Air taken into the inside of the engine cover 7 via the vent hole 7*a* is supplied to the engine section 2.

Figure 2:
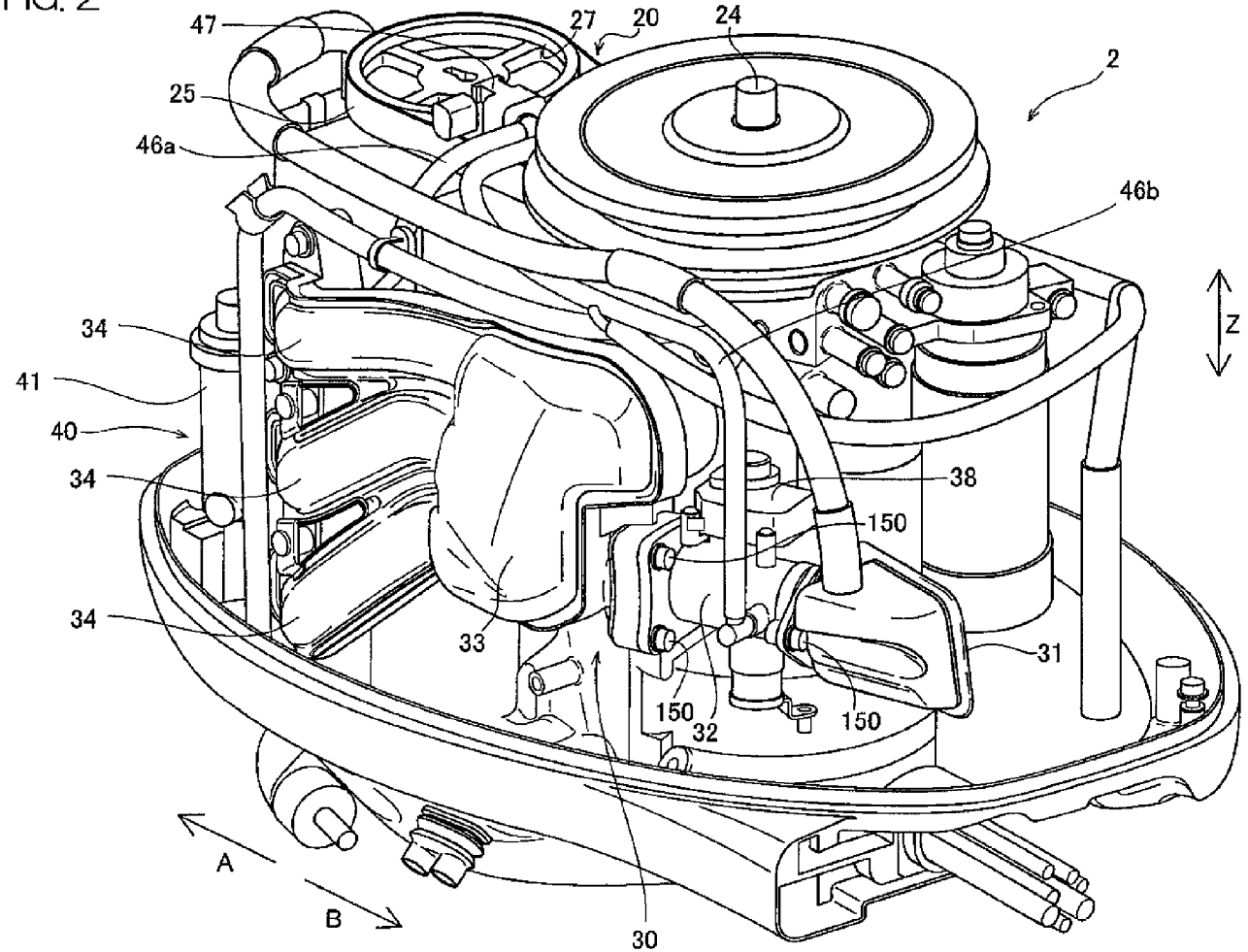
FIG. 2 is a perspective view showing an engine section of the outboard motor of the first preferred embodiment of the present invention.
Figure 3:
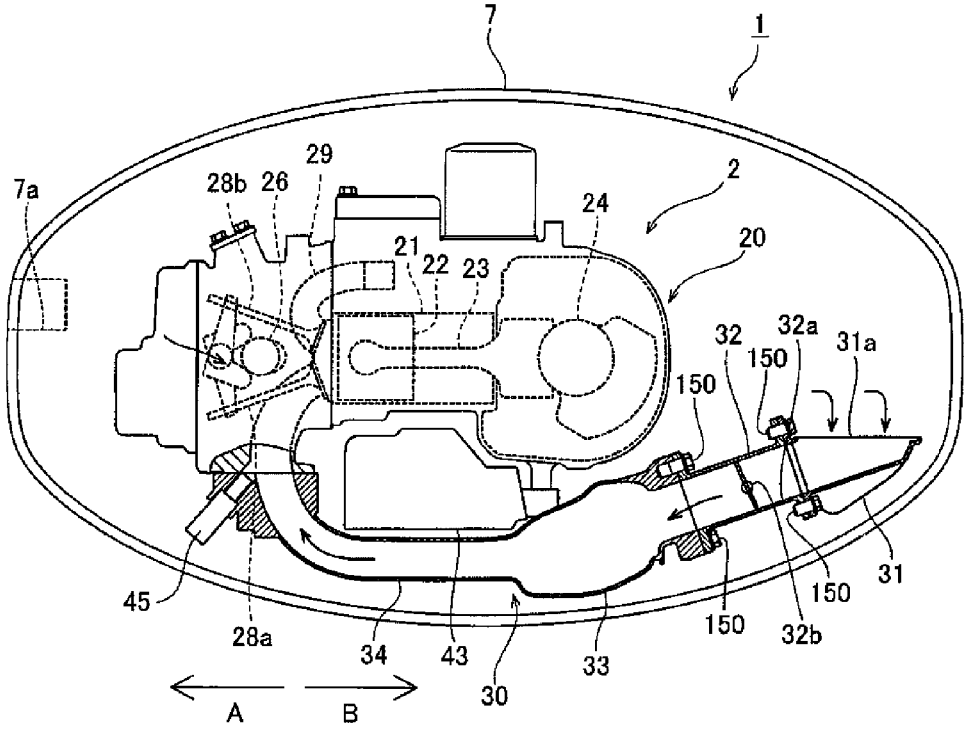
FIG. 3 is a plan view showing the engine section of the outboard motor of the first preferred embodiment of the present invention.
Figure 4:
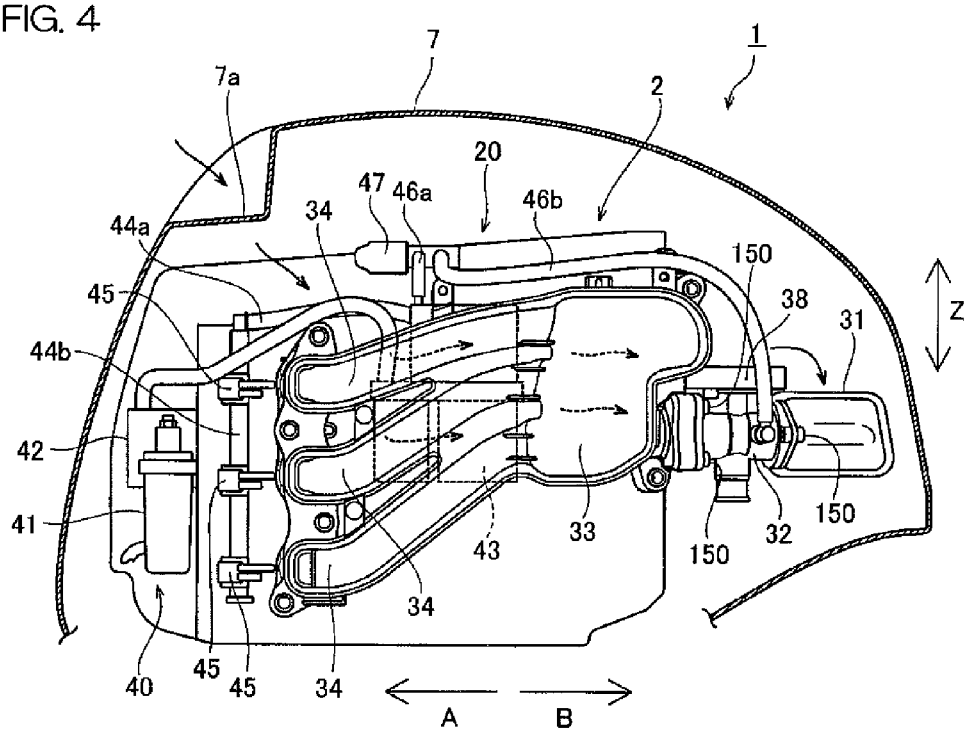
FIG. 4 is a side view showing the engine section of the outboard motor of the first preferred embodiment of the present invention.

FIG. 2 is a perspective view of the engine section 2, FIG. 3 is a plan view of the same, and FIG. 4 is a left side view of the same. Further, FIG. 5 shows a system arrangement of the outboard motor 1, and FIG. 6 shows an electric arrangement of major portions.

Figure 5:
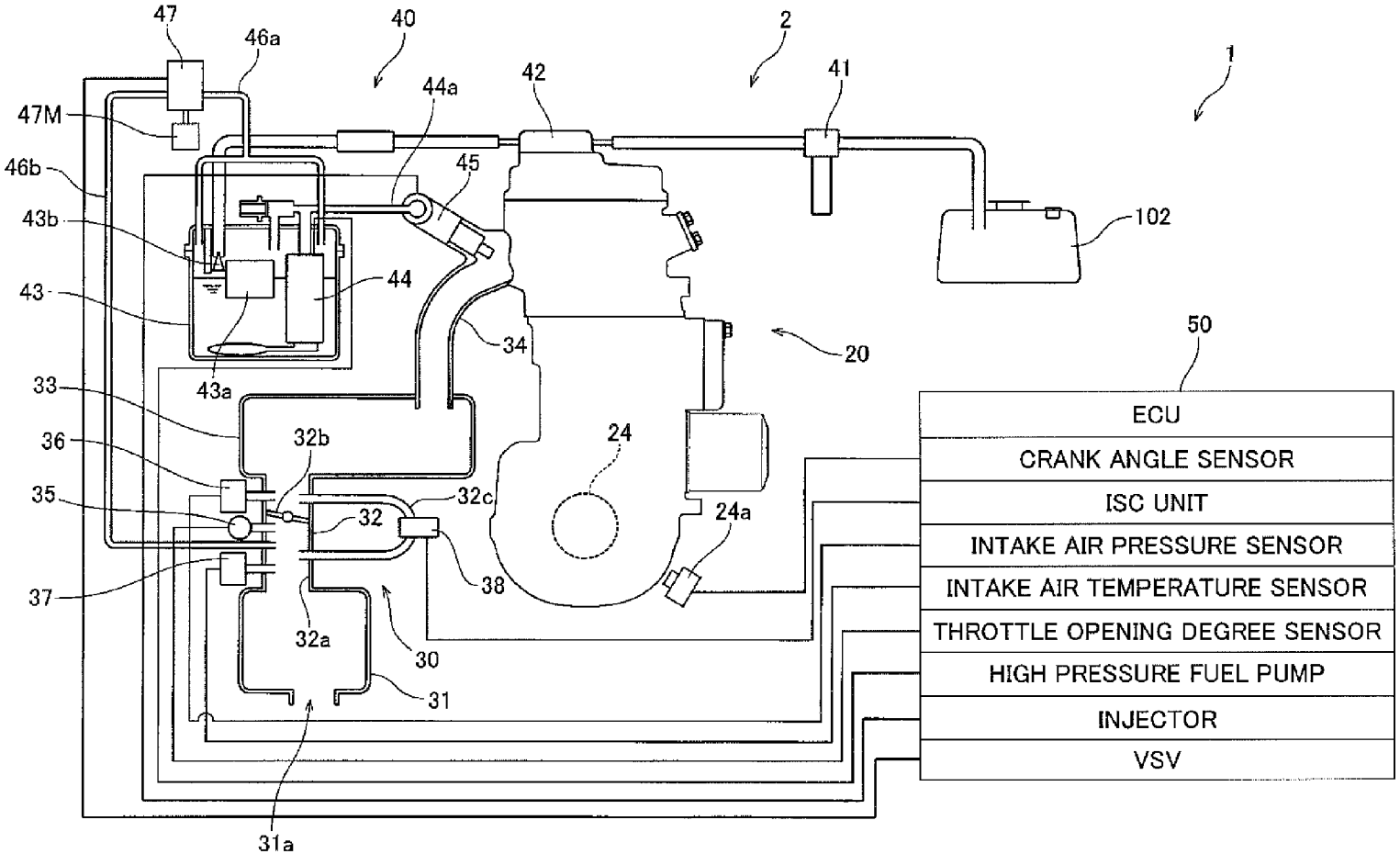
FIG. 5 is a system view of the outboard motor of the first preferred embodiment of the present invention.
Figure 6:
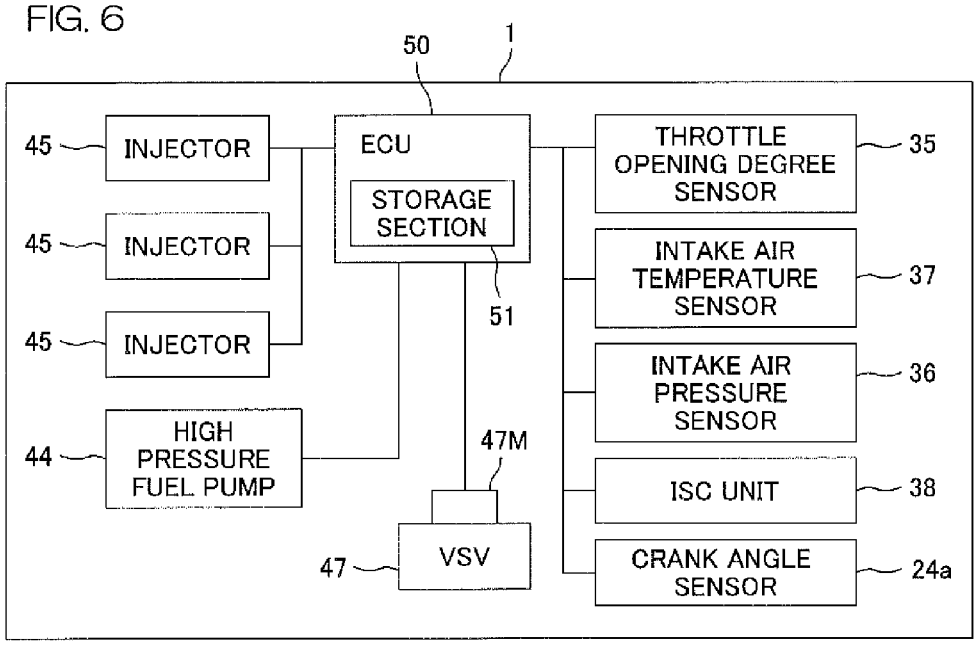
FIG. 6 is a block diagram showing an electric arrangement of major portions of the outboard motor of the first preferred embodiment of the present invention.

The engine section 2 includes an engine main body 20 (internal combustion engine), an intake system 30, a fuel system 40, and an ECU (Engine Control Unit) 50 (see FIG. 5 and FIG. 6). The intake system 30 supplies air to the engine main body 20. The fuel system 40 supplies fuel to the engine main body 20. For example, the engine main body 20 may be a four-stroke cycle engine with gasoline used as fuel. The engine main body 20 and the ECU 50 are examples of "engine" and "engine control unit" according to a preferred embodiment of the present invention, respectively.

As shown in FIG. 3, the engine main body 20 preferably includes three cylinders 21, for example, arranged in the up-down direction (Z direction of FIG. 2), and pistons 22 which move to reciprocate horizontally inside the cylinders 21. The pistons 22 are coupled to the crankshaft 24 via connecting rods 23. The crankshaft 24 extends in the up-down direction (Z direction). The horizontal reciprocation of the piston 22 is converted into rotating motion by the connecting rod 23 and the crankshaft 24. The lower end of the crankshaft 24 is connected to the drive shaft 3 (see FIG. 1).

The rotation of the crankshaft 24 is transmitted to a cam shaft 26. In detail, around a pulley (not shown) fixed to the upper portion of the crankshaft 24 and a pulley 27 (see FIG. 2) fixed to the cam shaft 26 (see FIG. 3), a belt 25 (see FIG. 2) is wound. Accordingly, the rotation of the crankshaft 24 is transmitted to the cam shaft 26. By the rotation of the cam shaft 26, intake valves 28*a* and exhaust valves 28*b* (see FIG. 3) of the respective cylinders 21 are driven at predetermined timings. Exhaust gas exhausted from the exhaust valve 28*b* is released to the outside via an exhaust passage 29.

As shown in FIG. 5, a crank angle sensor 24*a* is attached to the vicinity of the crankshaft 24. The ECU 50 can calculate the engine speed based on an output value of the crank angle sensor 24*a*.

As shown in FIG. 2 to FIG. 4, the intake system 30 is arranged lateral to the engine main body 20. In the present preferred embodiment, the intake system 30 is arranged along a side portion on the right side of the engine main body 20. The intake system 30 includes a silencer case 31, a throttle body 32, a surge tank 33, and preferably three intake pipes 34, for example. The silencer case 31 has an intake port 31*a* arranged on the forward drive direction (arrow B direction) side (see FIG. 3). To the silencer case 31, the throttle body 32 is connected. Further, to the throttle body 32, the surge tank 33 is connected. Three intake pipes 34 extend from the surge tank 33, and are respectively connected to intake ports of the three cylinders 21 of the engine main body 20. The throttle body 32 is coupled to the surge tank 33 with screws 150, and further coupled to the silencer case 31 with other screws 150.

The throttle body 32 may be made of resin or metal, and has an air passage 32*a* having an inner surface formed into a cylindrical shape as shown in FIG. 3 to FIG. 5. In the air passage 32*a*, a butterfly throttle valve 32*b* is provided. As shown in FIG. 5, a bypass air passage 32*c* is preferably integrally provided with the throttle body 32. The bypass passage 32*c* connects the upstream side and downstream side with respect to the throttle valve 32*b* of the air passage 32*a*. The bypass air passage 32*a* secures an air flow rate for maintaining an idling state when the throttle valve 32*b* is fully closed.

As shown in FIG. 5, to the throttle body 32, three sensors (a throttle opening degree sensor 35, an intake air pressure sensor 36, and an intake air temperature sensor 37) arranged to control the fuel injection amount of the injector 45 are attached. Further, to the throttle body 32, an idle speed control unit 38 (hereinafter, referred to as "ISC unit 38") arranged to adjust the air flow rate while idling is attached. The ISC unit 38 is arranged in the middle of the bypass air passage 32*c*. The ISC unit 38 arranged to control the flow rate of air passing through the bypass air passage 32*c* to control the engine speed while idling.

As shown in FIG. 2 to FIG. 5, the fuel system 40 includes a filter 41 connected to a fuel tank 102 (see FIG. 1 and FIG. 5) arranged in the hull 100, a low pressure fuel pump 42 connected to the filter 41, and a vapor separator tank 43 connected to the low pressure fuel pump 42. The fuel system 40 further includes a high pressure fuel pump 44 (see FIG. 5) which transports fuel in the vapor separator tank 43, and an injector 45 which injects the fuel transported by the high pressure fuel pump 44. The high pressure fuel pump 44 and the injector 45 are connected via a pipe 44*a* and a delivery pipe 44*b* (see FIG. 4).

The pipe 44*a* and the delivery pipe 44*b* are an example of "fuel pipe" according to a preferred embodiment of the present invention. Also the high pressure fuel pump 44 and the injector 45 are examples of "pump unit" and "fuel injection device" according to a preferred embodiment of the present invention, respectively.

The low pressure fuel pump 42 has a function to transport fuel into the vapor separator tank 43 from the fuel tank 102. The low pressure fuel pump 42 preferably is a mechanical driving pump which is driven in conjunction with the rotation of the crankshaft 24. When the fuel suctioned from the fuel tank 102 of the hull 100 by the low pressure fuel pump 42 passes through the filter 41, foreign matter contained in the fuel is removed.

The fuel fed by the low pressure fuel pump 42 is stored in the vapor separator tank 43. As shown in FIG. 3 and FIG. 4, the vapor separator tank 43 is arranged between the engine main body 20, surge tank 33, and the air intake pipe 34 as viewed in plan.

The vapor separator tank 43 stores the fuel suctioned up from the fuel tank 102, and separates fuel vapor or air and liquid fuel from each other. As shown in FIG. 5, the vapor separator tank 43 is configured such that the amount of the fuel stored in the vapor separator tank 43 is kept constant and the liquid level position of the fuel inside the vapor separator tank 43 is kept at a predetermined height position. In detail, a float 43*a* having a needle valve 43*b* is provided inside the vapor separator tank 43. When the liquid level position of the fuel in the vapor separator tank 43 becomes not lower than the predetermined height, the flow of the fuel into the vapor separator tank 43 is automatically stopped by the needle valve 43*b* of the float 43*a*. In addition, when the liquid level position of the fuel in the vapor separator tank 43 becomes lower than the predetermined height, the flow of the fuel into the vapor separator tank 43 is automatically started. With this arrangement, the amount of fuel stored in the vapor separator tank 43 is kept constant, and the liquid level position of the fuel in the vapor separator tank 43 is kept at the predetermined height.

The high pressure fuel pump 44 is arranged inside the vapor separator tank 43, and has a function to transport fuel with a predetermined pressure to the injector 45. The injector 45 has a function to inject the fuel fed at a predetermined pressure by the high pressure fuel pump 44 to the vicinity of the intake port of the cylinder 21 (see FIG. 3) at a predetermined timing. Also, a portion of fuel transported to the injector 45 from the high pressure fuel pump 44 is returned into the vapor separator tank 43 via a cooling device (not shown) which cools the fuel.

In addition, as shown in FIG. 2, FIG. 4, and FIG. 5, the upper portion of the vapor separator tank 43 is connected to the throttle body 32 via a pipe 46*a* and a pipe 46*b*. Accordingly, vapor in the vapor separator tank 43 is allowed to escape to the air passage 32*a* of the throttle body 32. Between the pipe 46*a* and the pipe 46*b*, a vapor shut valve 47 (hereinafter, referred to as "VSV 47") is provided. By controlling the VSV 47, the timing of allowing vapor to escape can be controlled.

The pipe 46*a* and the pipe 46*b* are an example of "vapor pathway" according to a preferred embodiment of the present invention. In the first preferred embodiment, the opening degree of the VSV 47 preferably is finely controllable by a stepping motor 47M.

As shown in FIG. 5 and FIG. 6, the ECU 50 electrically controls the high pressure fuel pump 44, the injector 45, the VSV 47 (stepping motor 47M) and the ISC unit 38. The fuel injection amount of the injector 45 is controlled based on the results of detections by the throttle opening degree sensor 35, the intake air temperature sensor 37, and the intake air pressure sensor 36 attached to the throttle body 32.

The ECU 50 closes the VSV 47 when stopping the engine section 2. In the first preferred embodiment, when starting the engine section 2, the ECU 50 controls the VSV 47 (stepping motor 47M) so as to gradually open the VSV 47 at a fixed speed.

In detail, the ECU 50 has a storage section 51 (see FIG. 6). In the storage section 51, a set value of the speed of opening the VSV 47 (valve opening speed) when starting the engine section 2 is stored. The valve opening speed is set through an experiment in advance such that the engine speed does not lower when opening the VSV 47 with the valve opening speed.

Figure 7:
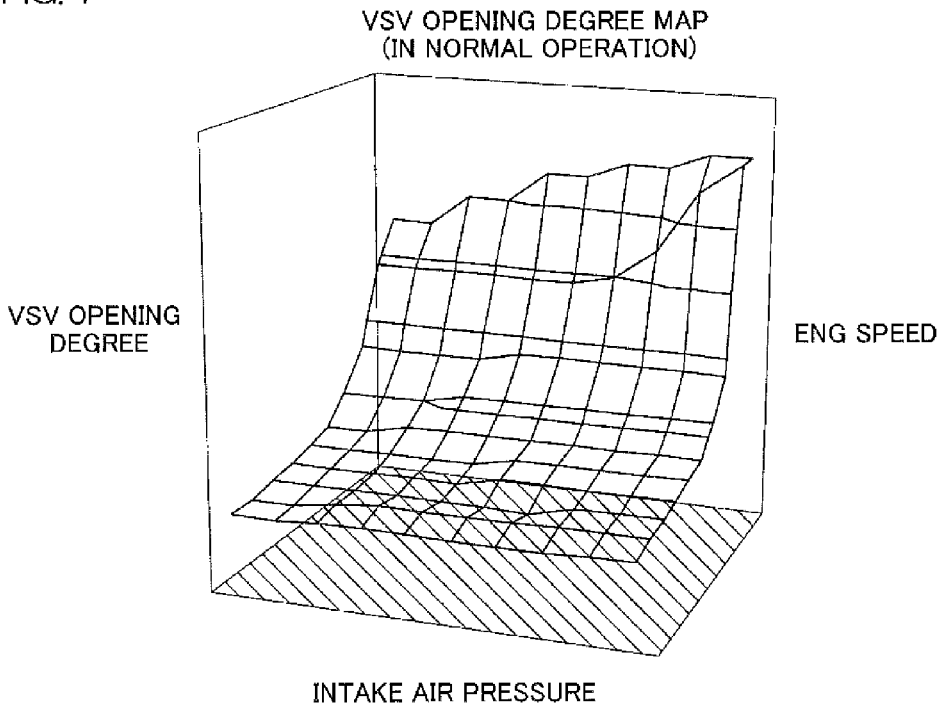
FIG. 7 is a map used for controlling the valve opening degree during normal operation of the outboard motor of the first preferred embodiment of the present invention.

In the storage section 51, a map for controlling the opening degree of the VSV 47 during normal operation (except for the time required to start the engine section 2) is also stored. An example of the map is shown in FIG. 7. In the normal operation, the ECU 50 reads out, from the map of FIG. 7, an opening degree set value of the VSV 47 based on a detected value detected by the intake air pressure sensor 36, and an engine speed.

"When starting the engine section 2" is a wide-ranging concept including not only the time to start the engine section 2 and the time immediately after starting the engine section 2, but also a period until reaching a normal operation state after the start of the engine section 2. In detail, "when starting the engine section 2" means a period until the fuel at a high temperature in the vapor separator tank 43 is replaced by fuel at a low temperature supplied from the fuel tank 102. Therefore, "normal operation state" means a state that the fuel at a high temperature in the vapor separator tank 43 has been discharged and replaced by the fuel at a low temperature supplied from the fuel tank 102.

The fuel at a high temperature is, for example, fuel at about 60° C. to about 65° C. The fuel at a low temperature is, for example, fuel at approximately 35° C. However, the fuel at a low temperature means fuel in the fuel tank 102, and the temperature thereof changes depending on the temperature inside the fuel tank 102.

The temperature of fuel in the vapor separator tank 43 can be detected by the fuel temperature sensor. Therefore, by providing a fuel temperature sensor, the period in which "control when starting the engine section 2" is performed can be determined based on an output of the fuel temperature sensor. Alternatively, a time necessary for replacing the fuel in the vapor separator tank 43 may be determined in advance. In the period until a predetermined time longer than such necessary time elapses immediately after the engine starts, the "control when starting the engine section 2" may be performed.

Figure 8:
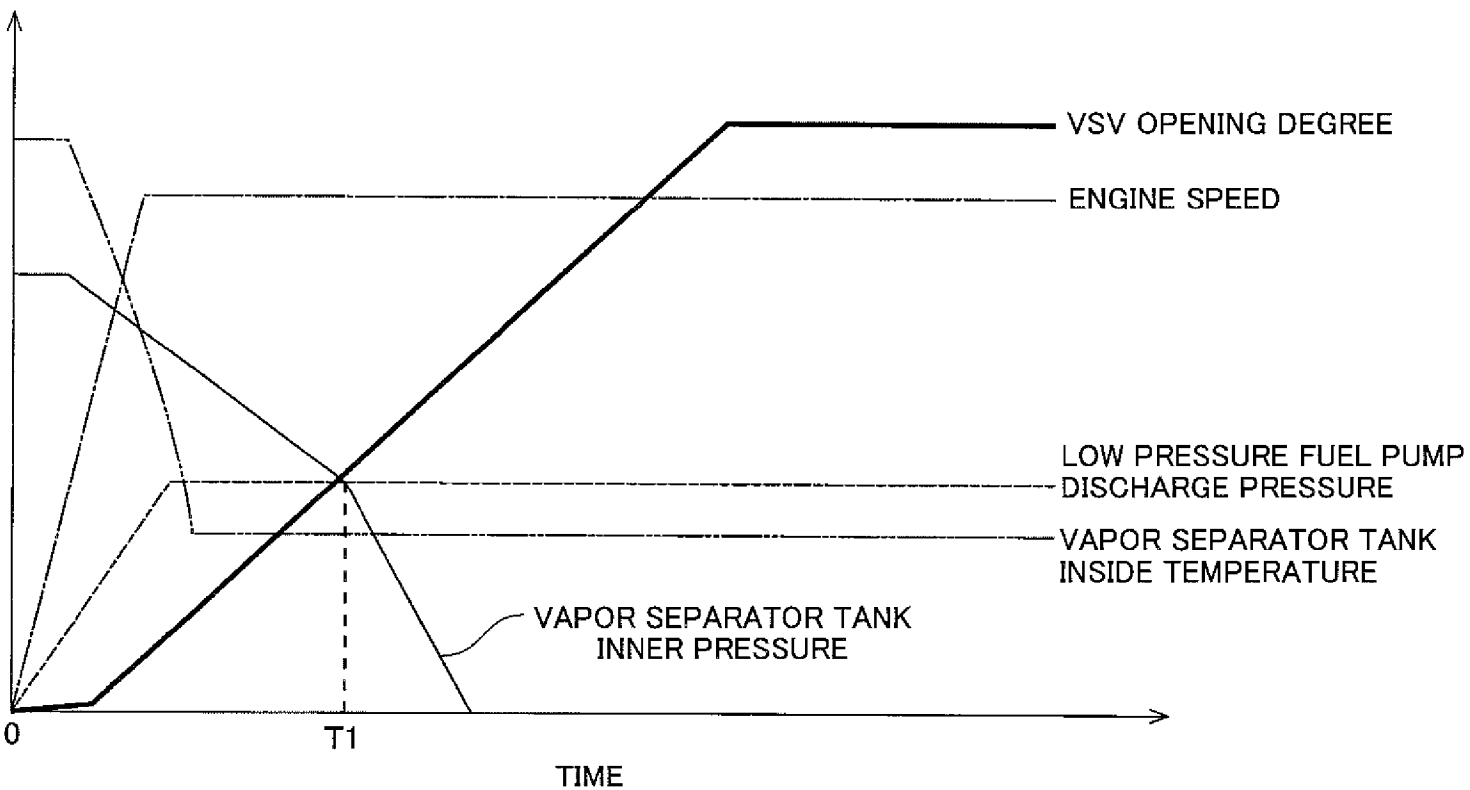
FIG. 8 is a graph for describing the valve opening degree and a state of the outboard motor when starting the engine of the outboard motor of the first preferred embodiment of the present invention.

Next, referring to FIG. 8, control of the VSV 47 when starting the engine of the outboard motor 1 of the first preferred embodiment will be described. FIG. 8 shows a situation when restarting the engine section 2. "When restarting" means a time at which the engine section 2 after being driven is stopped and then restarted while the temperature of the engine section 2 is high. FIG. 8 shows time changes of the opening degree of the VSV 47, the engine speed, the discharge pressure of the low pressure fuel pump 42, the temperature inside the vapor separator tank 43, and the inner pressure of the vapor separator tank 43 when throttle is fully open. The reason for full throttle is that a case is assumed such that the marine vessel is driven immediately after the engine section 2 is started.

As shown in FIG. 8, when the engine section 2 stops, a fuel cooling device (not shown) does not operate, and the vapor separator tank 43 is subjected to radiation heat from the engine main body 20 with high temperature. Therefore, the temperature inside the vapor separator tank 43 is high. Along with this, the fuel in the vapor separator tank 43 vaporizes, and vapor (fuel vapor) is generated in the vapor separator tank 43. While the engine section 2 is stopped, the VSV 47 is closed, so that the pressure inside the vapor separator tank 43 is increased by the generated vapor.

When the engine section 2 is started and the throttle is fully open, the engine speed rises to a predetermined speed, and is then kept at the speed. The discharge pressure of the low pressure fuel pump 42 which is driven in conjunction with the engine section 2 increases with an increase in engine speed, and is kept at a fixed discharge pressure thereafter. Immediately after starting, the inner pressure of the vapor separator tank 43 is higher than the discharge pressure of the low pressure fuel pump 42, so that new fuel is not supplied to the vapor separator tank 43.

In the first preferred embodiment, after the engine section 2 is started, the VSV 47 is opened at a fixed speed based on the valve opening speed (set value) stored in the storage section 51. As the VSV 47 opens, the vapor inside the vapor separator tank 43 is allowed to escape to the intake system 30 via the pipes 46*a* and 46*b*. Accordingly, the inner pressure of the vapor separator tank 43 gradually lowers. After time T1, the discharge pressure of the low pressure fuel pump 42 becomes higher than the inner pressure of the vapor separator tank 43, so that new fuel is supplied into the vapor separator tank 43. After starting the engine section 2, a fuel cooling device is driven, so that the temperature of the fuel in the vapor separator tank 43 lowers, and generation of vapor inside the vapor separator tank 43 is reduced. Thereafter, the operation shifts to normal operation.

In the first preferred embodiment, the speed of opening the VSV 47 is set to a suitable value, so that when starting the engine section 2, lowering of the engine speed and an occurrence of stall of the engine section 2 are prevented.

Next, with reference to FIG. 9 to FIG. 14, a method for setting the speed of opening the VSV 47 (valve opening speed) of the outboard motor 1 will be described.

Figure 9:
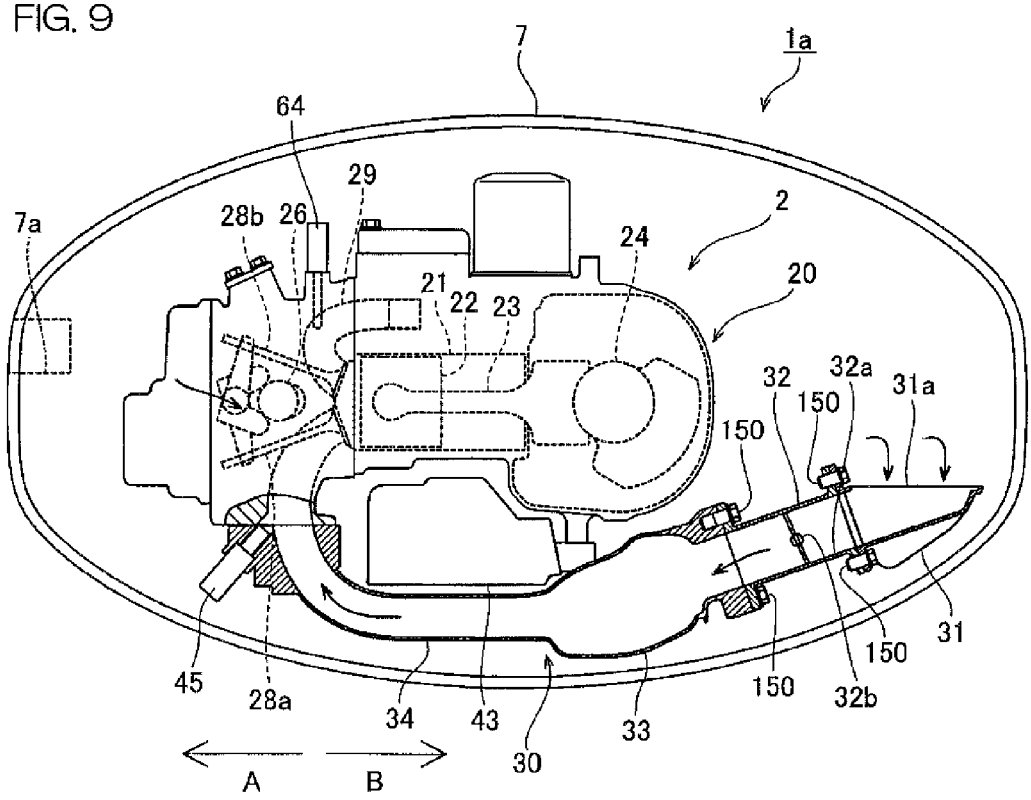
FIG. 9 is a plan view showing an outboard motor to be used in an experiment for determining a set value of a valve opening speed of the outboard motor of the first preferred embodiment of the present invention.
Figure 10:
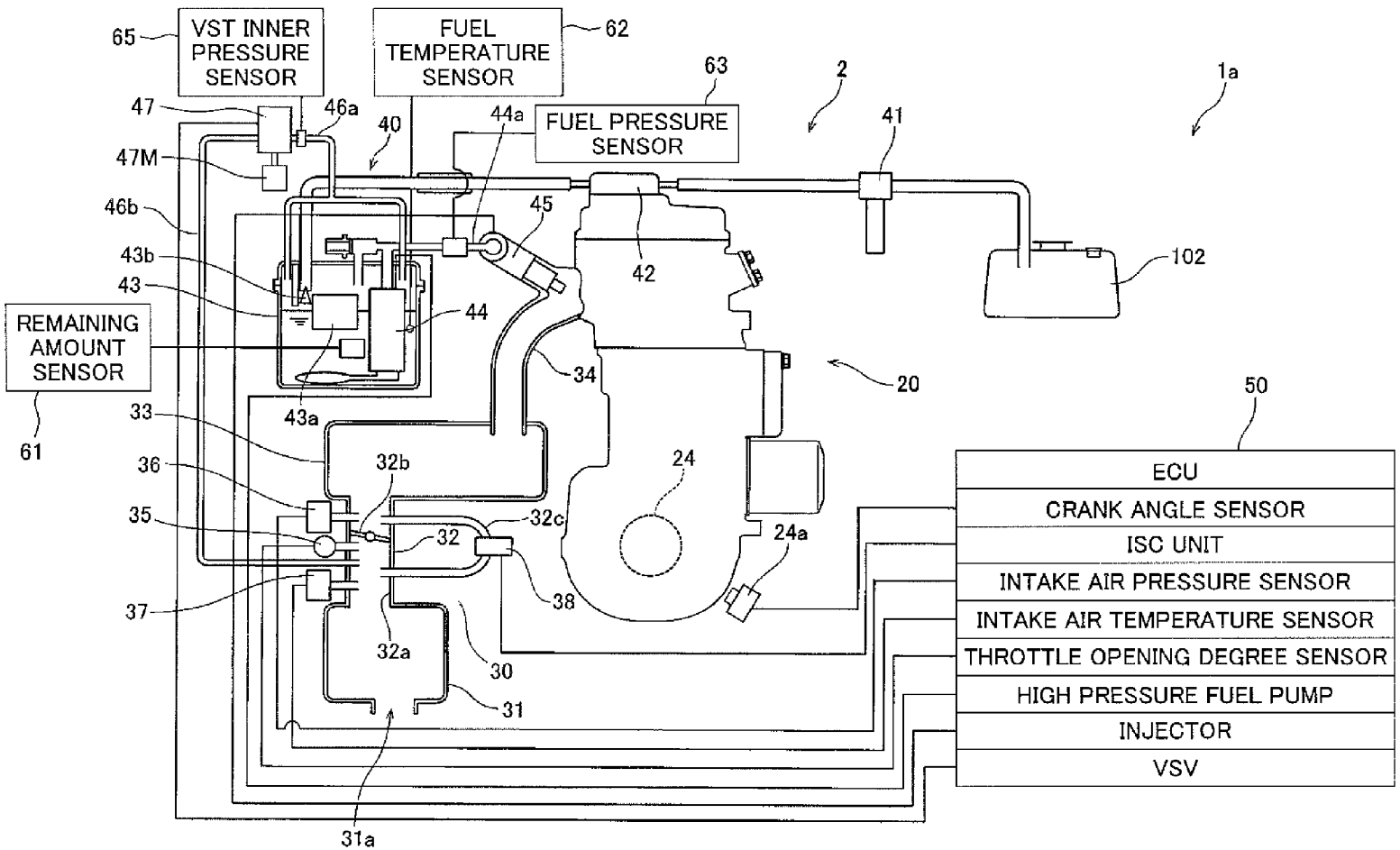
FIG. 10 is a system view showing an outboard motor to be used in an experiment for determining a set value of the valve opening speed of the outboard motor of the first preferred embodiment of the present invention.

For determining the opening speed of the VSV 47 (valve opening speed) which should be stored in the storage section 51 (see FIG. 6), an experiment is performed by using an experimental outboard motor 1*a* having the same arrangement as that of the outboard motor 1. As shown in FIG. 9 and FIG. 10, to the experimental outboard motor 1*a*, a remaining amount sensor 61, a fuel temperature sensor 62, a fuel pressure sensor 63, an A/F sensor 64 (see FIG. 9), and a VST inner pressure sensor 65 are attached. The remaining amount sensor 61 detects the remaining amount of fuel in the vapor separator tank 43. The fuel temperature sensor 62 detects the temperature of the fuel in the vapor separator tank 43. The fuel pressure sensor 63 detects the pressure of the fuel (fuel pressure) to be supplied to the injector 45 from the high pressure fuel pump 44. The A/F sensor 64 detects the air/fuel ratio of an air/fuel mixture supplied to the cylinder 21 of the engine main body 20. The VST inner pressure sensor 65 detects the inner pressure of the vapor separator tank 43. All output signals of these sensors are input into the ECU 50, for example.

The A/F sensor 64 is an example of the "air/fuel ratio sensor" according to a preferred embodiment of the present invention. As the remaining amount sensor 61, a sensor which detects motion of the float 43 by using electric resistance changes, a sensor which detects the position of the float 43*a* by using magnetism, or a sensor which detects the liquid level position by using ultrasonic waves can be used by way of example.

Figure 11:
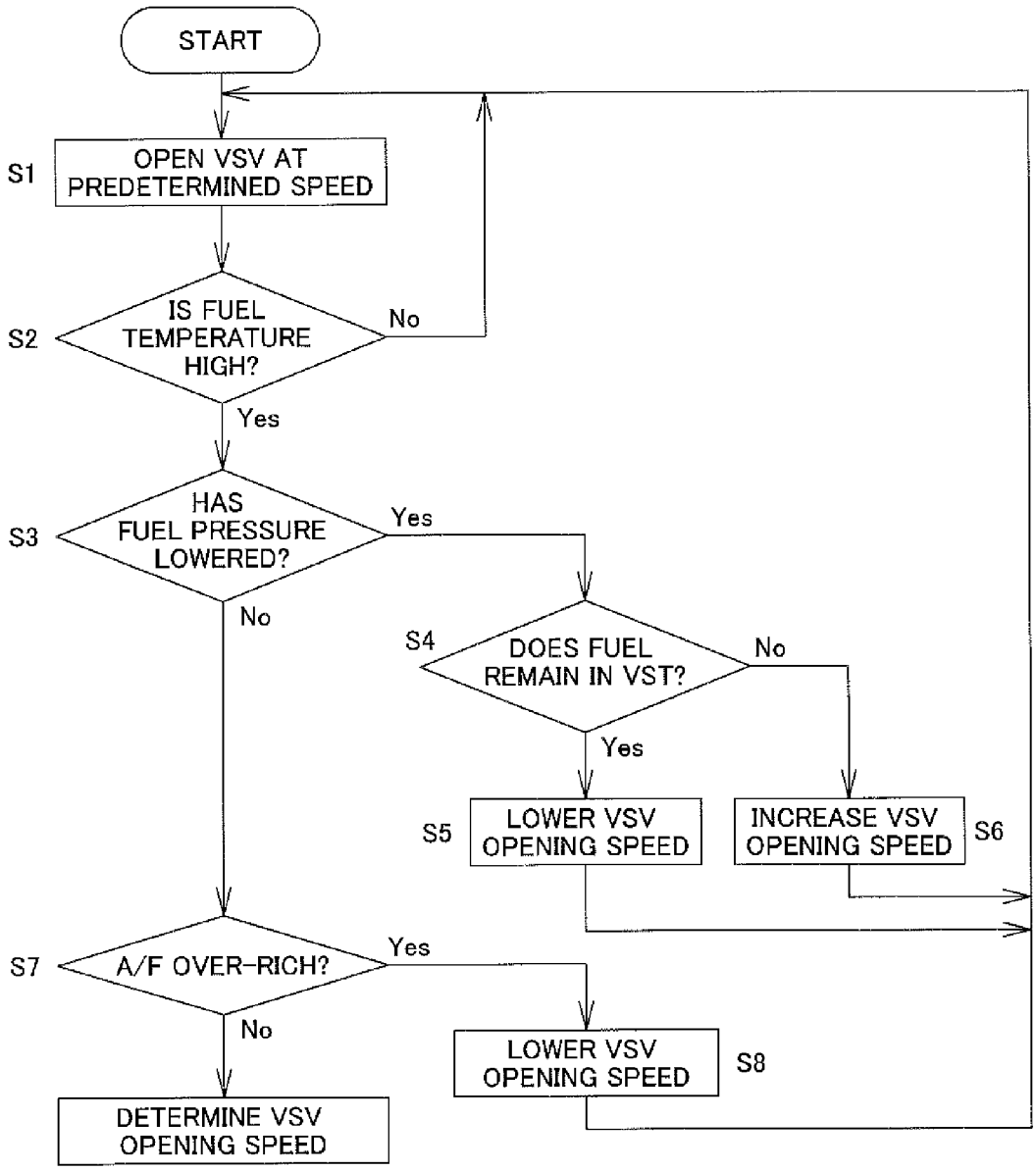
FIG. 11 is a flowchart for describing steps of determining a set value of the valve opening speed of the outboard motor of the first preferred embodiment of the present invention.

FIG. 11 is a flowchart showing detailed steps of determining the valve opening degree. An experiment is performed by using the experimental outboard motor la as follows. That is, the outboard motor la is operated, and the engine section 2 is stopped in a state that the temperature of the engine section 2 is high. Then, the engine section 2 is restarted, and the ECU 50 performs control to open the VSV 47 at a temporarily set value of opening speed (Step S1). Then, changes of output values of the sensors (the remaining amount sensor 61, the fuel temperature sensor 62, the fuel pressure sensor 63, the A/F sensor 64, and the VST inner pressure sensor 65) with the lapse of time are recorded.

In detail, a computer with a predetermined tool program installed is connected to the ECU 50. The computer can acquire and record the output signals of the sensors via the ECU 50. An operator of the experiment can set the opening speed of the VSV 47 (specifically, the pulse interval to be applied to the stepping motor 47M) to the ECU 50 by operating the computer.

The operator determines whether the fuel pressure or A/F is abnormal by referring to output values of the sensors recorded as described above. In detail, first, based on the output of the fuel temperature sensor 62, it is determined whether the temperature of fuel in the vapor separator tank 43 when starting the engine section 2 is equal to or higher than a predetermined temperature (Step S2). Here, the predetermined temperature is, for example, approximately 45° C. which causes the fuel to boil and vaporize. When the temperature of the fuel in the vapor separator tank 43 is not lower than the predetermined temperature, vapor is generated in the vapor separator tank 43 and may cause the engine section 2 to stall. On the other hand, when the temperature of the fuel in the vapor separator tank 43 is lower than the predetermined temperature (when the engine section 2 is cooled), very little vapor is generated in the vapor separator tank 43, and the influence of the opening speed of the VSV 47 on the engine section 2 is small. Therefore, data when the engine section 2 is cooled is not used for setting the opening speed of the VSV 47 in the case of the engine section 2 at a high temperature, and the experiment is made again (Step S2: NO).

When the temperature of the fuel in the vapor separator tank 43 is equal to or higher than the predetermined temperature (Step S2: YES), at Step S3, the operator determines whether the fuel pressure has decreased on the data acquired by the fuel pressure sensor 63. When the fuel pressure lowers, it becomes difficult for the injector 45 to inject a proper amount of fuel, and causes the engine section 2 to stall. Therefore, the process advances to Step S4, and the operator adjusts the opening speed of the VSV 47 (Steps S5 and S6). The fuel pressure lowering is judged based on not only the output of the fuel pressure sensor 63 but also the output of the VST inner pressure sensor 65 and the output of the fuel temperature sensor 62.

At Step S4, the operator determines whether fuel remains in the vapor separator tank 43 based on an output value of the remaining amount sensor 61. When fuel remains (Step S4: YES), it is determined that the high pressure fuel pump 44 has been clogged with bubbles. In other words, when the opening speed of the VSV 47 is too fast, vapor in the vapor separator tank 43 is rapidly allowed to escape to the intake system. Therefore, the pressure inside the vapor separator tank 43 suddenly lowers, so that the fuel bubbles due to vacuum boiling. If the high pressure fuel pump 44 suctions bubbles, it becomes difficult for the high pressure fuel pump 44 to transport the fuel normally, so that the fuel pressure lowers (Step S3: YES).

Figure 12:
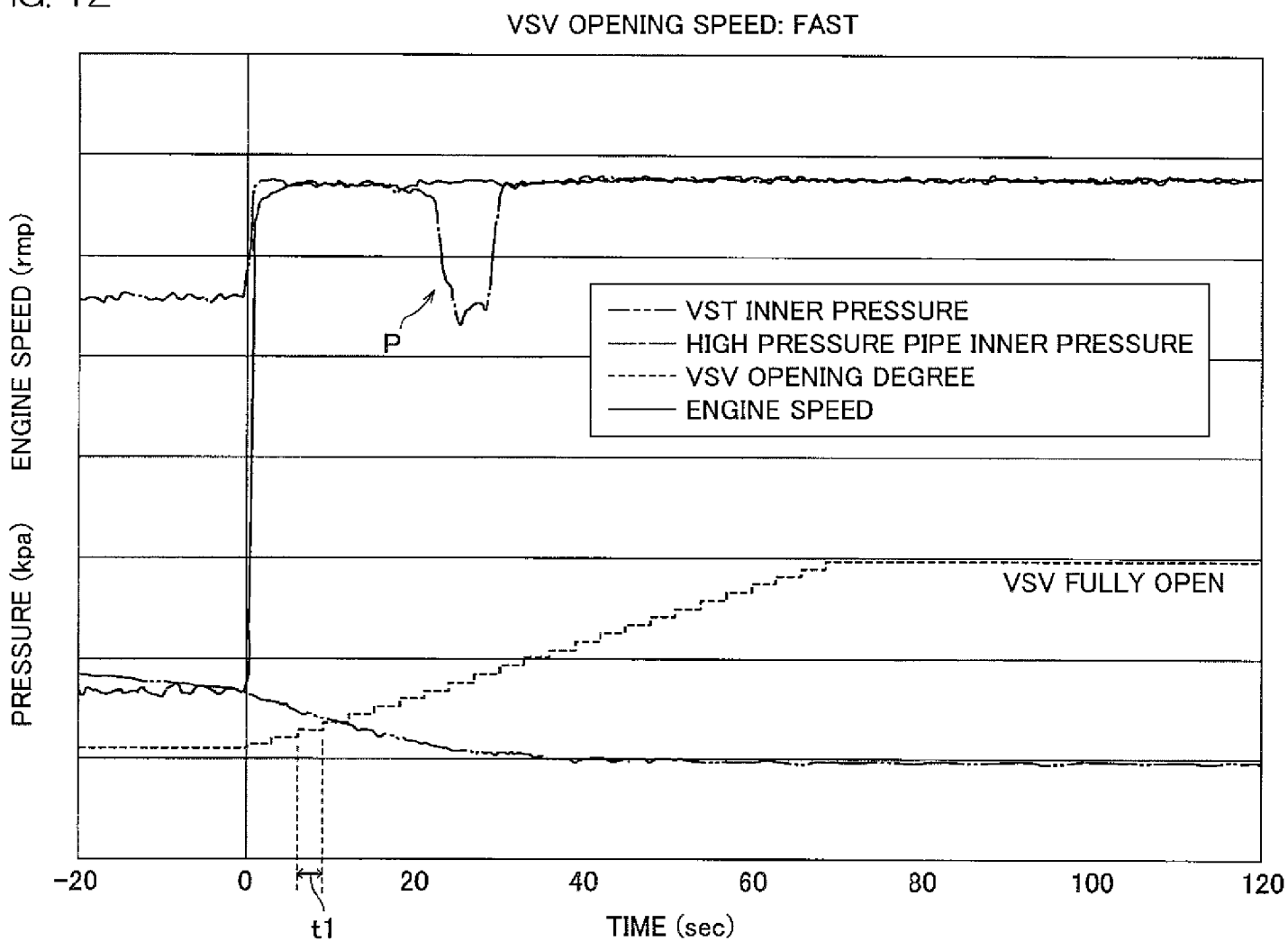
FIG. 12 is a graph showing a state of the outboard motor when the opening speed of the valve is too fast in the steps of determining the set value of the valve opening speed of the outboard motor of the first preferred embodiment of the present invention.

FIG. 12 is a graph of data actually acquired when the opening speed of the VSV 47 is too fast. In FIG. 12, the interval t1 of pulses to be input into the stepping motor 47M of the VSV 47 is preferably set to about 3 seconds, for example. In the graph of FIG. 12, lowering of the fuel pressure is observed at the portion indicated by the arrow P. In FIG. 12, lowering of the engine speed is not observed; however, when the fuel pressure greatly lowers, it can result in lowering of the engine speed and an occurrence of stall of the engine section 2.

Therefore, when fuel remains at Step S4 of FIG. 11, it is determined that the opening speed of the VSV 47 is too fast. Then, at Step S5, the operator sets the opening speed of the VSV 47 to be slower by increasing the interval of pulses to be input into the stepping motor 47M. Thereafter, the process returns to Step S1, and the same experiment as described above is performed at the opening speed of the VSV 47 that has been made slower.

At Step S4, when it is determined that fuel does not remain in the vapor separator tank 43, it is determined that a fuel shortage has occurred. In other words, when the opening speed of the VSV 47 is too slow, it takes time for the vapor to escape from the vapor separator tank 43. Therefore, the time (T1 of FIG. 8) until the discharge pressure of the low pressure fuel pump 42 becomes higher than the inner pressure of the vapor separator tank 43 after the start of the engine section 2 becomes longer. Until the time T1 elapses after the start of the engine section 2, new fuel is not supplied into the vapor separator tank 43. Therefore, when the fuel in the vapor separator tank 43 is consumed before the time T1 elapses, a fuel shortage occurs. In the case of fuel shortage, it also becomes difficult for the high pressure fuel pump 44 to normally transport fuel, so that the fuel pressure lowers (Step S3: YES).

Figure 13:
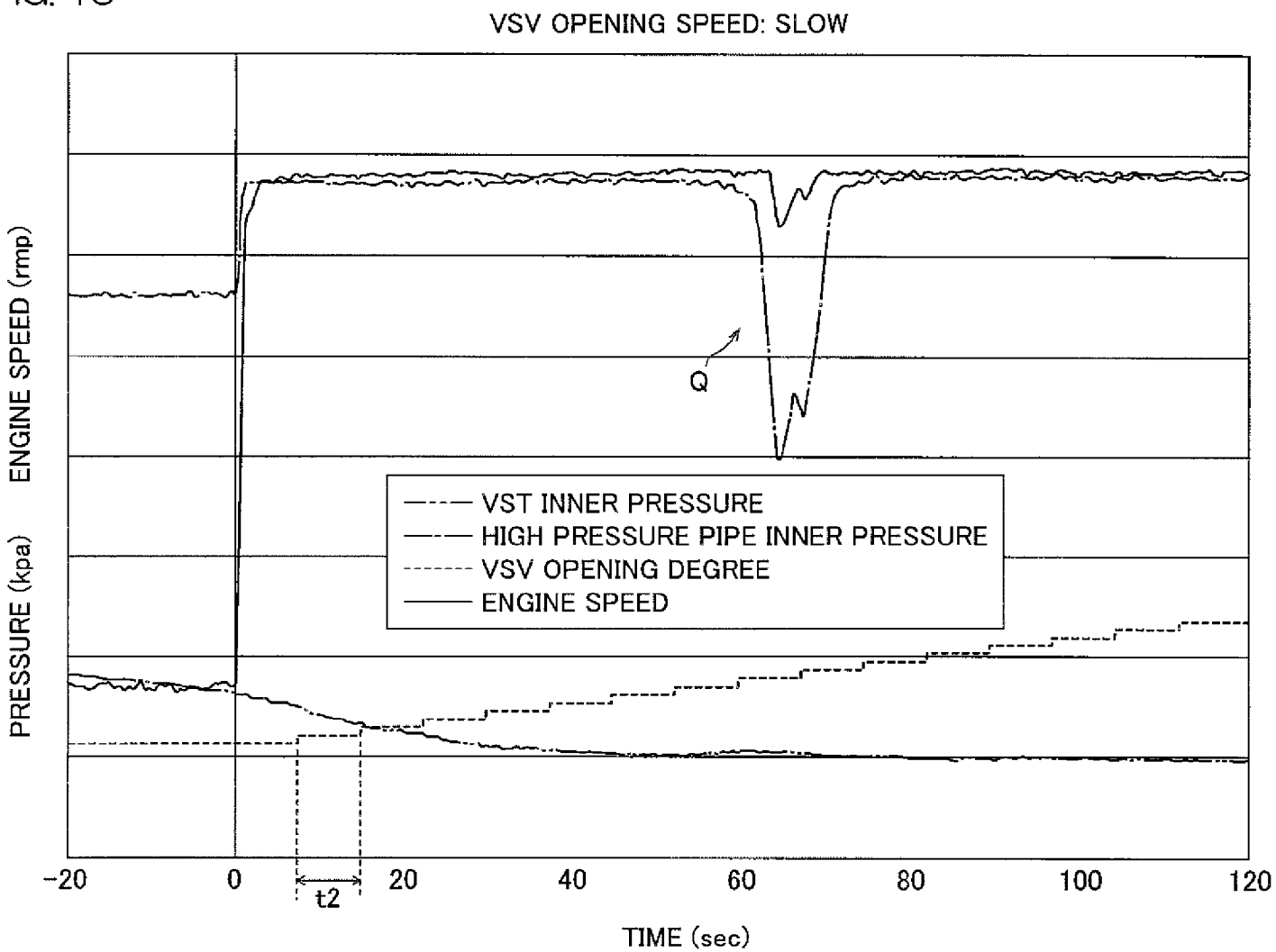
FIG. 13 is a graph showing a state of the outboard motor when the opening speed of the valve is too slow in the steps of determining the set value of the valve opening speed of the outboard motor of the first preferred embodiment of the present invention.

FIG. 13 is a graph of data actually acquired when the opening speed of the VSV 47 is too slow. In FIG. 13, the interval t2 of pulses to be input into the stepping motor 47M of the VSV 47 is set to about 7.5 seconds, for example. In the graph of FIG. 13, lowering of the fuel pressure and lowering of the engine speed are observed at the portion indicated by the arrow Q.

Therefore, when fuel does not remain at Step S4, it is determined that the opening speed of the VSV 47 is too slow. Then, at Step S6, the operator increases the opening speed of the VSV 47 by reducing the interval of pulses to be input into the stepping motor 47M. Thereafter, the process returns to Step S1, and the same experiment as described above is made at the increased opening speed of the VSV 47.

In addition, when lowering of the fuel pressure is not found at Step S3, the operator determines whether the air/fuel mixture has become excessively fuel-rich (over-rich) based on an output value of the A/F sensor 64 at Step S7. That is, when the opening speed of the VSV 47 is too fast, vapor inside the vapor separator tank 43 is taken all at once into the intake system 30. As a result, the air/fuel mixture may become excessively fuel-rich. In this case, the combustion of the air/fuel mixture becomes abnormal, and this may cause the engine section 2 to stall. When the air/fuel mixture is not excessively fuel-rich at Step S7, the operator determines the opening speed of the VSV 47 of Step S1 as a set value (valve opening speed) and ends the opening speed setting of the VSV 47.

When the air/fuel mixture is excessively fuel-rich at Step S7, the opening speed of the VSV 47 is too fast, so that the operator lowers the opening speed of the VSV 47 at Step S8. In other words, the operator makes longer the interval of pulses to be applied to the stepping motor 47M. Thereafter, the process returns to Step S1, and the same experiment as described above is made at the decreased opening speed of the VSV 47.

Thus, by repeating Step S1 to Step S8 described above, the opening speed of the VSV 47 which does not cause the engine section 2 to stall when starting the engine section 2 can be determined.

Figure 14:
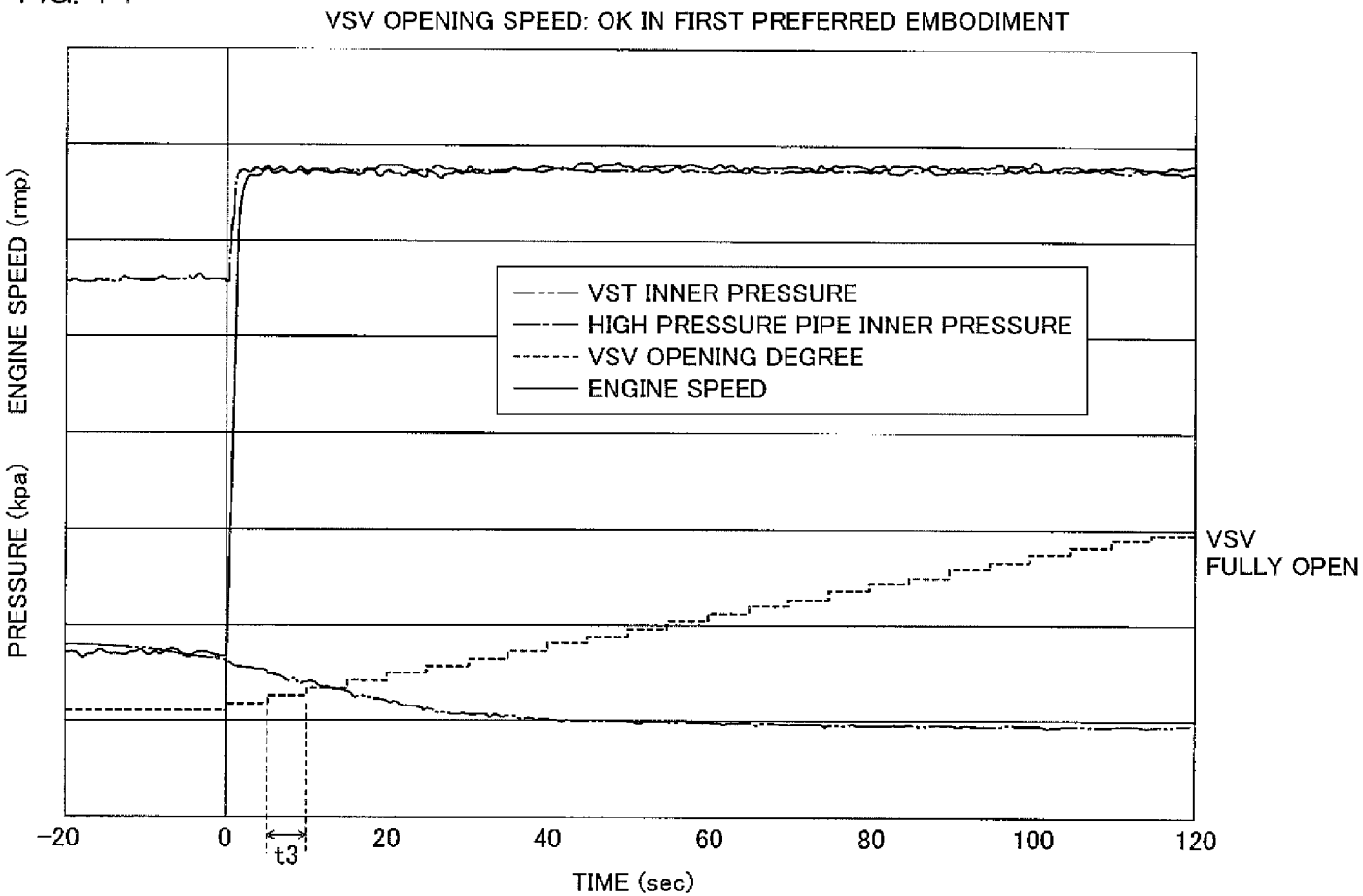
FIG. 14 is a graph showing a state of the outboard motor when the opening speed of the valve is proper in the steps of determining the set value of the valve opening speed of the outboard motor of the first preferred embodiment of the present invention.

FIG. 14 is a graph of data actually acquired when the opening speed of the VSV 47 was adjusted to a proper value. In FIG. 14, the interval t3 of pulses to be input into the stepping motor 47M of the VSV 47 is set to about 5 seconds, for example. In the graph of FIG. 14, lowering of the fuel pressure and the lowering of the engine speed are not observed. Therefore, different from the cases of FIG. 12 (high opening speed) and FIG. 13 (low opening speed), an occurrence of stall of the engine section 2 is prevented when starting the engine.

In this description, the graphs of data acquired when the pulse intervals t1, t2, and t3 preferably are respectively set to about 3 seconds, about 7.5 seconds, and about 5 seconds are shown. However, these values are merely examples, and optimum values differ depending on the measurement environment and the used device.

As described above, in the present preferred embodiment, the opening speed of the VSV 47 is determined based on data acquired through an experiment made with full throttle after the engine section 2 is started. The reason for this is as follows. That is, when the throttle is fully open, the load on the engine section 2 becomes the highest, and lowering of the fuel pressure and engine stall easily occur. Therefore, by determining the opening speed of the VSV 47 based on results of the experiment made with full throttle, engine stall may not occur even when the opening of the throttle is not full.

Examples of technical advantages of the first preferred embodiment are as follows.

In the first preferred embodiment, by controlling the opening degree of the VSV 47 such that the opening speed set base on the pressure of the fuel (fuel pressure) inside the pipe 44*a* is attained, the VSV 47 can be opened without lowering of the pressure of the fuel inside the pipe 44*a*. Accordingly, the engine section 2 can be prevented from stalling due to lowering of the pressure of the fuel inside the pipe 44*a*.

In the first preferred embodiment, when starting the engine section 2, the opening degree of the VSV 47 is controlled such that the opening speed set also based on the air/fuel ratio of the air/fuel mixture to be supplied to the engine section 2, in addition to the fuel pressure, is attained. Accordingly, the air/fuel mixture to be supplied to the engine section 2 can be prevented from becoming excessively fuel-rich. Accordingly, the engine section 2 can be prevented from stalling due to an excessively fuel-rich state of the air/fuel mixture.

In the first preferred embodiment of the present invention, when starting the engine section 2, the opening degree of the VSV 47 is controlled such that the opening speed set also based on the remaining amount of the fuel in the vapor separator tank 43, in addition to the fuel pressure, is attained. In the case where the pressure of the fuel inside the pipe 44*a* is low, when the remaining amount of the fuel in the vapor separator tank 43 is large, it can be determined that the lowering of the pressure of the fuel inside the pipe 44*a* is caused by bubble clogging. On the other hand, in the case where the pressure of the fuel inside the pipe 44*a* is low, when the remaining amount of the fuel in the vapor separator tank 43 is small, it can be determined that the lowering of the pressure of the fuel inside the pipe 44*a* is caused by fuel shortage. By thus identifying the cause of the lowering of the pressure of the fuel inside the pipe 44*a*, the opening speed of the VSV 47 can be more properly set. Accordingly, the engine section 2 can be further prevented from stalling. In addition, when setting the valve opening speed, a proper valve opening speed can be determined quickly.

Also, in the first preferred embodiment, when starting the engine section 2, the opening degree of the VSV 47 is controlled based on the set value (valve opening speed) stored in the storage section 51. In other words, a set value of the opening speed of the VSV 47 which at least does not cause lowering of the pressure of the fuel inside the pipe 44*a* is obtained through an experiment, and based on the set value, the opening degree of the VSV 47 is controlled. Accordingly, without providing a sensor, etc., the opening degree of the VSV 47 can be easily controlled so as not to cause the engine section 2 to stall.

In the first preferred embodiment, by controlling the opening degree of the VSV 47 such that the VSV 47 is opened at a fixed speed, the opening degree of the VSV 47 can be easily controlled.

Second Preferred Embodiment

Figure 15:
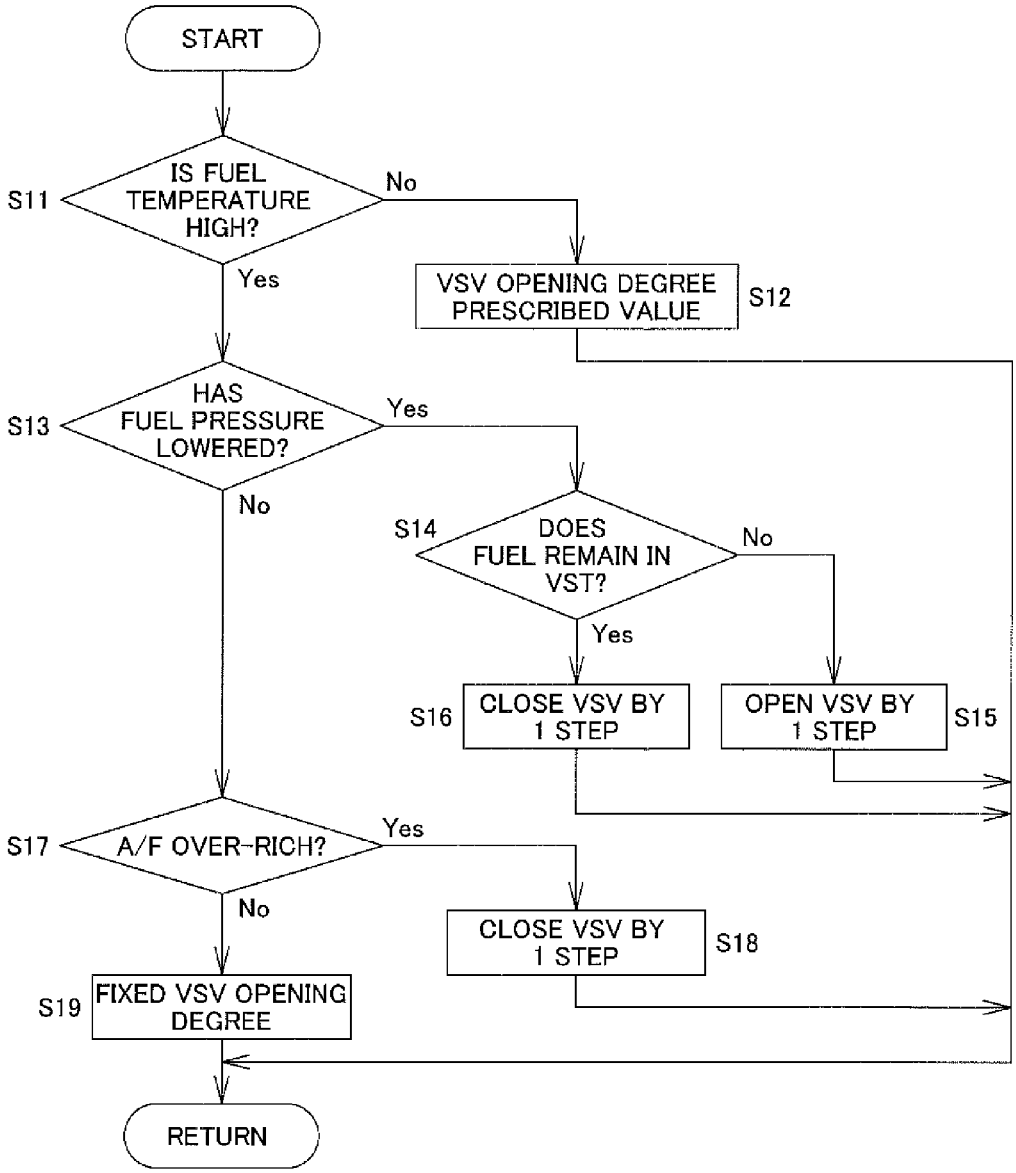
FIG. 15 is a flowchart for describing control of the valve opening degree of an outboard motor of a second preferred embodiment of the present invention.
Figure 16:
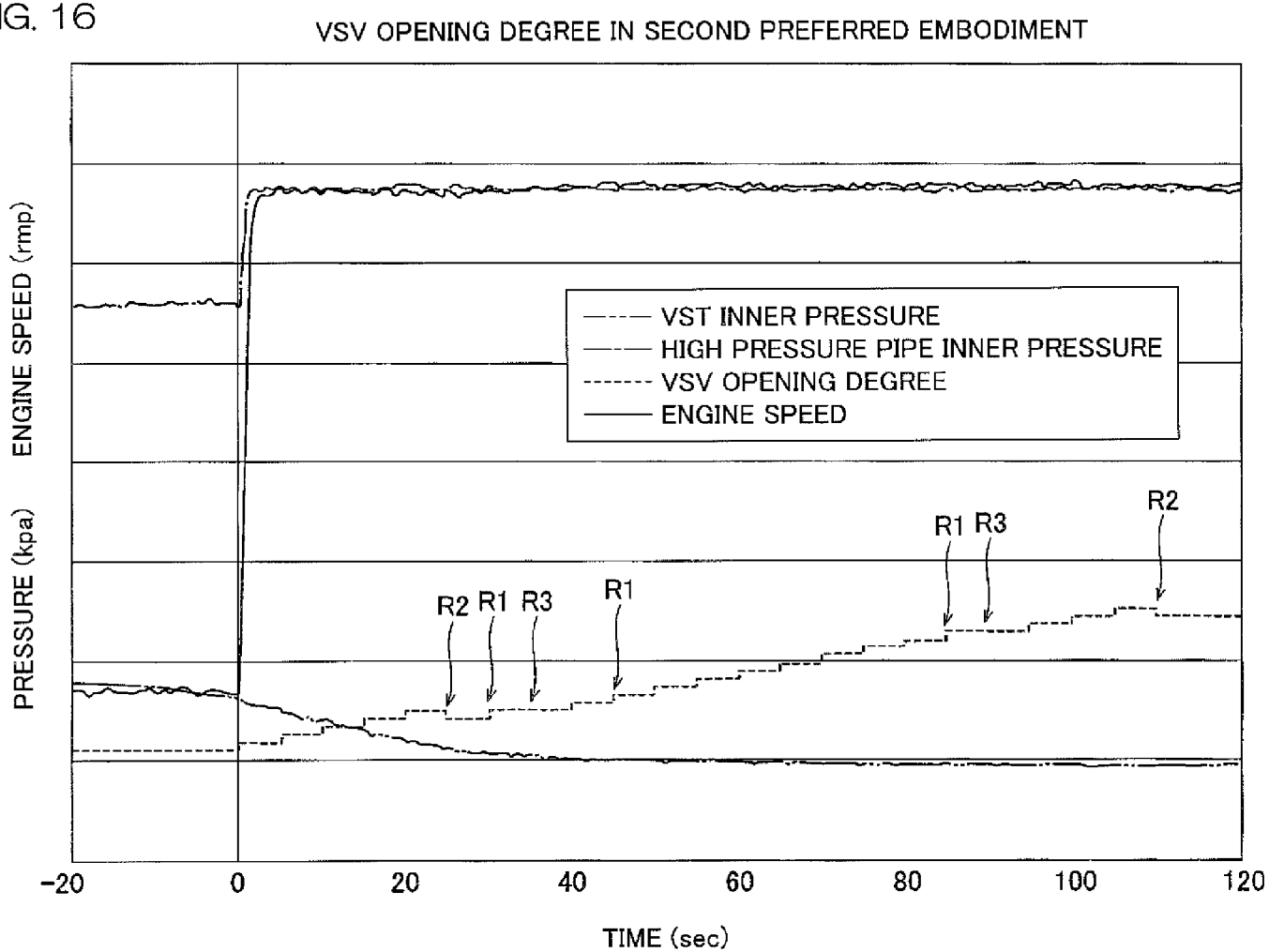
FIG. 16 is a graph for describing changes in valve opening degree when starting the engine of the outboard motor of the second preferred embodiment of the present invention.

FIG. 15 is a flowchart for describing control of the VSV when starting an engine of an outboard motor of a second preferred embodiment of the present invention, showing processing to be repeated each predetermined time (control cycle) by the ECU 50 when starting the engine. FIG. 16 is a graph for describing changes in opening degree of the VSV when starting the engine of the outboard motor of the second preferred embodiment of the present invention. In the first preferred embodiment described above, the opening degree of the VSV 47 preferably is controlled based on the valve opening speed (set value) stored in advance. On the other hand, in the second preferred embodiment, by correcting the opening speed of the VSV 47 in real time based on outputs of sensors, the opening degree of the VSV 47 is preferably controlled. The mechanical structure of the outboard motor of the second preferred embodiment is the same as that of the outboard motor 1*a* shown in FIG. 9 and FIG. 10, so that description thereof will be omitted.

In the outboard motor of the second preferred embodiment, when starting the engine, the ECU 50 determines whether the temperature of the fuel in the vapor separator tank 43 is high (not lower than about 45° C., for example) based on an output value of the fuel temperature sensor 62 (Step S11). When the temperature of the fuel is not high, the ECU 50 refers to a VSV opening degree map for normal operation (see FIG. 7) based on an engine speed obtained from an output of the crank angle sensor 24*a* and an output value of the intake air pressure sensor 36. The ECU 50 reads out a corresponding valve opening degree and applies it. In other words, the ECU 50 controls the opening degree of the VSV 47 to the value of normal operation (VSV opening degree prescribed value).

When the temperature of the fuel is high (Step S11: YES), at Step S13, the ECU 50 determines whether the fuel pressure has decreased based on output values of the VST inner pressure sensor 65, the fuel temperature sensor 62, and the fuel pressure sensor 63. The VST inner pressure sensor 65 is an example of "vapor separator tank inner pressure sensor" according to a preferred embodiment of the present invention.

When it is determined at Step S13 that the fuel pressure has decreased, at Step S14, the ECU 50 determines whether the fuel remains in the vapor separator tank 43 based on an output value of the remaining amount sensor 61. When fuel does not remain, it is determined that fuel shortage occurs, so that vapor inside the vapor separator tank 43 must be allowed to escape quickly. Therefore, at Step S15, the ECU 50 opens the VSV 47 by one step as shown by the arrows R1 in FIG. 16. Thereafter, the process of the ECU 50 returns to Step S11.

When it is determined at Step S14 that fuel remains in the vapor separator tank 43, it is determined that bubble clogging occurs, so that an occurrence of foaming due to vacuum boiling must be prevented. Therefore, at Step S16, the ECU 50 closes the VSV 47 by one step as shown by the arrows R2 in FIG. 16. Thereafter, the process of the ECU 50 returns to Step S11.

When it is determined at Step S13 that the fuel pressure has not decreased, at Step S17, the ECU 50 determines whether the air/fuel ratio is excessively high based on an output value of the A/F sensor 64. When the air/fuel ratio is excessively high, it is determined that the VSV 47 is open excessively, so that at Step S18, the ECU 50 closes the VSV 47 by one step. Also, when the air/fuel ratio is not excessively high, the opening degree of the VSV 47 is proper, so that at Step S19, the ECU 50 keeps the opening degree of the VSV 47 without change as shown by the arrows R3 in FIG. 16.

Thus, in the second preferred embodiment, the ECU 50 repeats Step S11 to Step S19 described above each predetermined time period. Accordingly, the ECU 50 increases, reduces, or keeps the opening degree of the VSV 47 to correct the opening speed of the VSV 47 each predetermined time. Accordingly, the opening degree of the VSV 47 is controlled in real time.

In the second preferred embodiment, when starting the engine section 2, the ECU 50 acquires the pressure of the fuel inside the pipe 44*a* detected by the fuel pressure sensor 63 each predetermined time. Then, the ECU 50 controls the opening degree of the VSV 47 based on the detected value detected by the fuel pressure sensor 63. Accordingly, the opening degree of the VSV 47 can be set in real time to an opening degree suitable for the state of the outboard motor.

Other advantages of the second preferred embodiment are the same as those of the first preferred embodiment described above.

A detailed description has been provided of the preferred embodiments of the present invention. However, the preferred embodiments are only specific examples to describe the technical content of the present invention, and the present invention is not to be construed as limited to these specific examples. The spirit and scope of the present invention are restricted only by the appended claims.

For example, the first preferred embodiment described above shows an example in which the VSV 47 is preferably controlled to open at a fixed opening speed when starting the engine. However, the present invention is not limited to this, and the speed of opening the VSV 47 may not be fixed.

In the first and second preferred embodiments described above, an example in which the present invention is applied to the outboard motor 1 is shown. However, the present invention is not limited to this, and the present invention is also applicable to an inboard motor or an inboard/outboard motor.

In the first preferred embodiment described above, an example in which an experiment for determining the set value of the opening speed of the VSV 47 is preferably made by a person. However, the present invention is not limited to this, and the set value may be automatically determined by a computer installed with a program for performing the experiment for determining the set value of the opening speed of the VSV 47.

The present application corresponds to Japanese Patent Application No. 2008-205027 filed in the Japan Patent Office on Aug. 8, 2008, and the entire disclosure of the application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine vessel propulsion device comprising:
an engine;
a fuel injection device arranged to inject fuel to the engine;
an intake system including an air passage arranged to supply air to the engine;
a vapor separator tank arranged to separate fuel vapor from liquid fuel to be supplied to the engine;
a pump unit arranged to transport the fuel from the vapor separator tank to the fuel injection device;
a fuel pipe arranged to connect the fuel injection device and the pump unit;
a vapor pathway arranged to connect the vapor separator tank and the intake system;
a valve disposed in the vapor pathway; and
an engine control unit programmed to control an opening degree of the valve to be a plurality of values from closed to open, when starting the engine, in accordance with a valve opening speed set based on at least a pressure of fuel inside the fuel pipe.

2. The marine vessel propulsion device according to claim 1, wherein the engine control unit is programmed to control the opening degree of the valve in accordance with a valve opening speed set based on an air/fuel ratio of an air/fuel mixture to be supplied to the engine, in addition to the pressure of the fuel inside the fuel pipe, when starting the engine.

3. The marine vessel propulsion device according to claim 1, wherein the engine control unit includes a storage section arranged to store a valve opening degree set in advance, and the engine control unit is programmed to control the opening degree of the valve in accordance with a valve opening speed stored in the storage section when starting the engine.

4. The marine vessel propulsion device according to claim 3, wherein the engine control unit is programmed to control the opening degree of the valve so as to open the valve at a fixed speed in accordance with a valve opening speed stored in the storage section when starting the engine.

5. A marine vessel propulsion device comprising:
an engine;
a fuel injection device arranged to inject fuel to the engine;
an intake system including an air passage arranged to supply air to the engine;
a vapor separator tank arranged to separate fuel vapor from liquid fuel to be supplied to the engine;
a pump unit arranged to transport the fuel from the vapor separator tank to the fuel injection device;
a fuel pipe arranged to connect the fuel injection device and the pump unit;
a vapor pathway arranged to connect the vapor separator tank and the intake system;
a valve disposed in the vapor pathway; and
an engine control unit programmed to control an opening degree of the valve, when starting the engine, in accordance with a valve opening speed set based on at least a pressure of fuel inside the fuel pipe; wherein
the engine control unit is programmed to control the opening degree of the valve in accordance with a valve opening speed based on a remaining amount of fuel in the vapor separator tank, in addition to the pressure of the fuel inside the fuel pipe, when starting the engine.

6. A marine vessel propulsion device comprising:
an engine;
a fuel injection device arranged to inject fuel to the engine;
an intake system including an air passage arranged to supply air to the engine;
a vapor separator tank arranged to separate fuel vapor from liquid fuel to be supplied to the engine;
a pump unit arranged to transport the fuel from the vapor separator tank to the fuel injection device;
a fuel pipe arranged to connect the fuel injection device and the pump unit;
a fuel pressure sensor arranged to detect a pressure of fuel inside the fuel pipe;
a vapor pathway arranged to connect the vapor separator tank and the intake system;
a valve disposed in the vapor pathway; and
an engine control unit programmed to control an opening degree of the valve to be a plurality of values from closed to open, when starting the engine, based on at least a detected value detected by the fuel pressure sensor.

7. The marine vessel propulsion device according to claim 6, further comprising:
an air/fuel ratio sensor arranged to detect an air/fuel ratio of an air/fuel mixture to be supplied to the engine; wherein
the engine control unit is programmed to control the opening degree of the valve based on a detected value detected by the air/fuel ratio sensor, in addition to a detected value detected by the fuel pressure sensor, when starting the engine.

8. The marine vessel propulsion device according to claim 6, wherein the engine control unit is programmed to acquire a detected value detected by the fuel pressure sensor every predetermined time period, and to control the opening degree of the valve based on at least the detected value detected by the fuel pressure sensor when starting the engine.

9. The marine vessel propulsion device according to claim 8, wherein the engine control unit is programmed to change an opening speed of the valve by increasing, reducing, or keeping the opening degree of the valve for every predetermined time period when starting the engine.

10. A marine vessel propulsion device comprising:
an engine;
a fuel injection device arranged to inject fuel to the engine;
an intake system including an air passage arranged to supply air to the engine;
a vapor separator tank arranged to separate fuel vapor from liquid fuel to be supplied to the engine;
a pump unit arranged to transport the fuel from the vapor separator tank to the fuel injection device;
a fuel pipe arranged to connect the fuel injection device and the pump unit;
a fuel pressure sensor arranged to detect a pressure of fuel inside the fuel pipe;
a vapor pathway arranged to connect the vapor separator tank and the intake system;
a valve disposed in the vapor pathway;
an engine control unit programmed to control an opening degree of the valve, when starting the engine, based on at least a detected value detected by the fuel pressure sensor; and
a remaining amount sensor arranged to detect a remaining amount of fuel in the vapor separator tank; wherein
the engine control unit is programmed to control the opening degree of the valve based on a detected value detected by the remaining amount sensor, in addition to a detected value detected by the fuel pressure sensor, when starting the engine.

11. A marine vessel propulsion device comprising:
an engine;
a fuel injection device arranged to inject fuel to the engine;
an intake system including an air passage arranged to supply air to the engine;
a vapor separator tank arranged to separate fuel vapor from liquid fuel to be supplied to the engine;
a pump unit arranged to transport the fuel from the vapor separator tank to the fuel injection device;
a fuel pipe arranged to connect the fuel injection device and the pump unit;
a fuel pressure sensor arranged to detect a pressure of fuel inside the fuel pipe;
a vapor pathway arranged to connect the vapor separator tank and the intake system;
a valve disposed in the vapor pathway;
an engine control unit programmed to control an opening degree of the valve, when starting the engine, based on at least a detected value detected by the fuel pressure sensor; and
a fuel temperature sensor arranged to detect a temperature of fuel in the vapor separator tank; wherein
the engine control unit is programmed to set the opening degree of the valve to a prescribed value when the temperature of the fuel detected by the fuel temperature sensor is lower than a predetermined temperature, and to control the opening degree of the valve based on at least a detected value detected by the fuel pressure sensor when the temperature of the fuel detected by the fuel temperature sensor is not lower than the predetermined temperature when starting the engine.

* * * * *